United States Patent [19]

Jacobson

[11] 4,358,970

[45] Nov. 16, 1982

[54] POWER DRIVEN BOTTLE CAP REMOVER

[76] Inventor: Don Jacobson, 799 W. Robin, Placentia, Calif. 92670

[21] Appl. No.: 234,638

[22] Filed: Feb. 17, 1981

[51] Int. Cl.[3] ..... B67B 7/16; B67B 7/18

[52] U.S. Cl. ..... 81/3.2

[58] Field of Search ..... 81/3.2; 53/381 A, 381 R

[56] References Cited

U.S. PATENT DOCUMENTS 1,340,551 5/1920 Madsen ..... 81/3.2
1,598,392 8/1926 Risser ..... 81/3.2

FOREIGN PATENT DOCUMENTS 2212659 11/1978 Fed. Rep. of Germany ..... 81/3.2
914693 1/1963 United Kingdom ..... 81/3.2

*Primary Examiner*—Roscoe V. Parker
*Attorney, Agent, or Firm*—William C. Babcock

[57] ABSTRACT

A power driven device for twisting a crown cap from a neck of a bottle as the cap and neck are inserted into a cup shaped driven head that pivotally supports a number of cap engaging knives. The head contains a spring loaded member that moves the loosened cap outwardly with the neck, as the latter is withdrawn from the head. A sring mounted on the interior of the head separates the cap from the neck should the cap tend to cling to the latter.

7 Claims, 6 Drawing Figures

FIG. 1
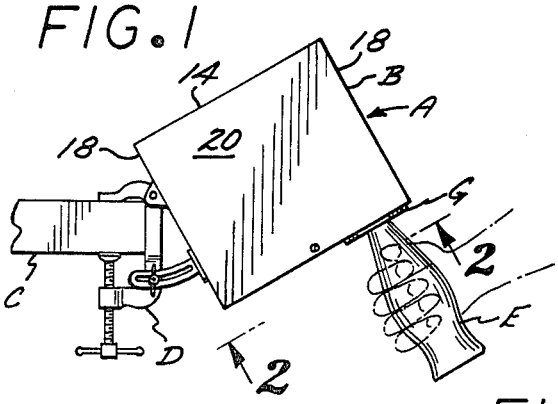
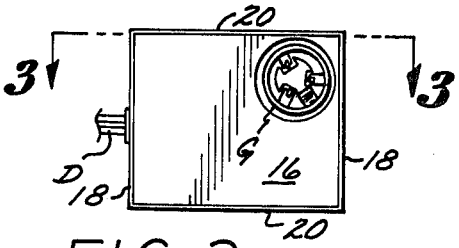
FIG. 2
FIG. 3
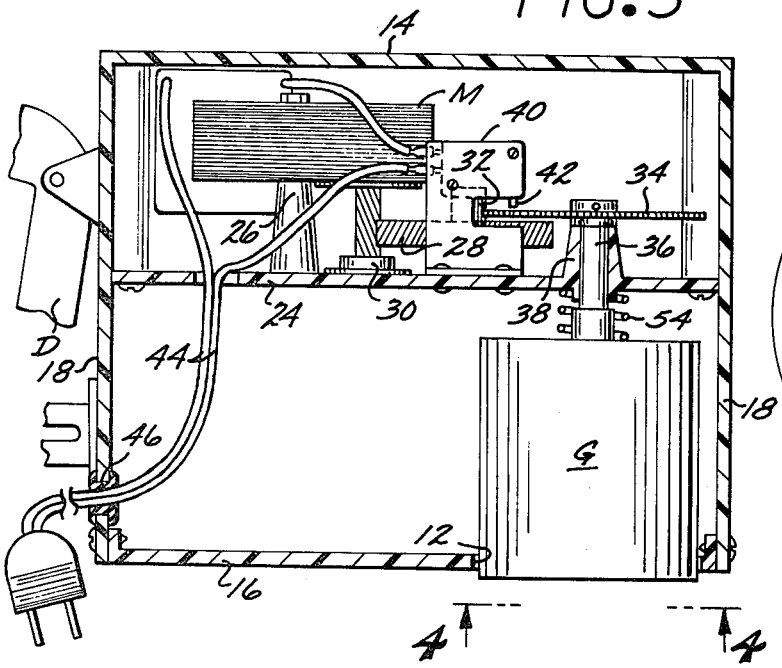
FIG. 4
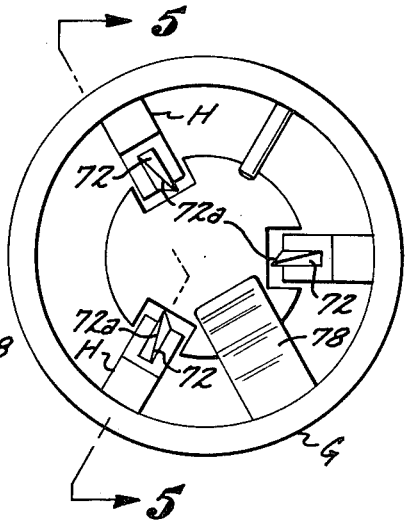
FIG. 5
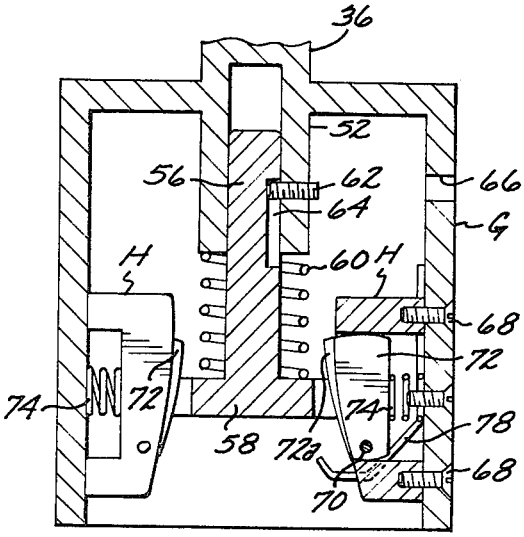
FIG. 6
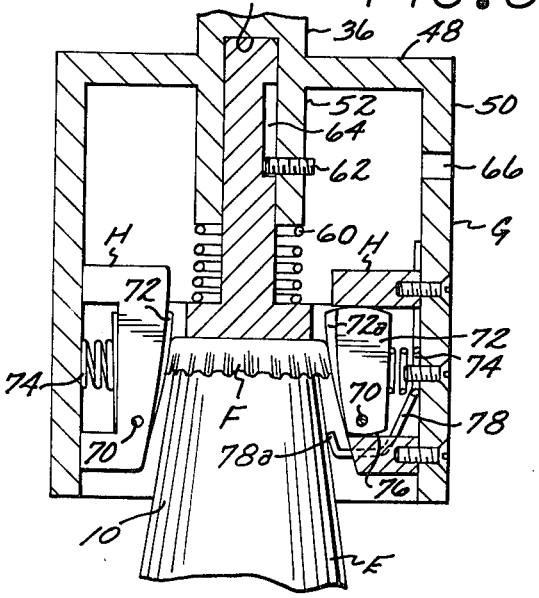

POWER DRIVEN BOTTLE CAP REMOVER

BACKGROUND OF THE INVENTION

1. Field of the Invention

Power Driven Bottle Cap Remover

2. Description of the Prior Art

In bars and entertainment centers that sell a substantial volume of bottled beer, the removal of caps from the necks of the bottles is time consuming and when done rapidly may result in the heads of the bottles being chipped or the necks of the bottles broken if the glass defining the same has not been amended properly.

A major object of the present invention is to provide a power operated device that twists a crown cap loose from the head of the bottle on which it is mounted when the neck is inserted in a power driven head, automatically moves the loosened cap outwardly with the neck of the bottle as the neck is removed from the head, and a spring separating the cap from the neck if the loosened cap tends to cling thereto.

Another object of the invention is to furnish a bottle cap remover for use in bars or in the home, one that is easily operated and has a simple mechanical structure, requires a minimum of maintenance attention, and may be sold at a sufficiently low price as to encourage the wide spread use thereof.

SUMMARY OF THE INVENTION

The invention preferably includes a protective housing and a clamp that removably supports the housing at a convenient location in a bar or in the home. A power driven inverted cup shaped head is axially aligned with an opening in the housing. The housing contains a number of circumferentially spaced, pivotally supported knives that engage the cap on the neck of a bottle when the neck is at least partially inserted in the head.

Insertion of the neck into the head results in the latter rotating, and the knives gripping the cap to twist the cap loose from the neck. A spring loaded member moves the loosened cap outwardly with the neck as the latter is withdrawn from the head. A spring situated within the head separates the loosened cap from the neck should the cap tend to cling thereto, with the separated cap then dropping down to the ground or a suitable container due to gravity.

DESCRIPTION OF THE DRAWING

FIG. 1 is a side elevational view of the bottle cap remover;

FIG. 2 is a bottom plan view of the cap remover taken on the line 2—2 of FIG. 1;

FIG. 3 is a transverse cross sectional view of the cap remover taken on the line 3—3 of FIG. 2;

FIG. 4 is an end view of the power driven head taken on the line 4—4 of FIG. 3;

FIG. 5 is a longitudinal cross sectional view of the head taken on the line 5—5 of FIG. 4; and FIG. 6 is the same view as shown in FIG. 5 with the cap of the bottle being gripped by a number of pivotally supported knives in the head to be twisted from the neck as the head rotates.

DESCRIPTION OF THE PREFERRED EMBODIMENT

The power driven device A of the present invention is shown in FIG. 1 and includes a protective housing B that by a support D is secured in a convenient position on a bar C. A bottle E that has a neck on which a crown cap F is mounted may have the cap removed by inserting the neck into an inverted, cup shaped, power driven head G that is disposed within the housing and axially aligned with a housing opening 12.

The housing is illustrated in the drawing as including a top 14, bottom 16, pair of end walls 18, and pair of sidewalls 20, all of which cooperate to define a confined space within the housing.

The housing has a support plate 24 therein as shown in FIG. 3, to which an electric motor M is secured by a member 26.

A number of speed reducing gears 28 are driven by motor M, with the gears and supporting shafts referred to collectively by the numeral 30 being rotatably supported from plate 24 by conventional means. The gears 28 include a first elongate driven gear 32 that is engaged by a second gear that may move longitudinally relative to the first gear.

The second gear 34 is rigidly secured to the upper end of a driven shaft 36 that is rotatably and slidably mounted in a tubular boss that extends upwardly from support plate 24.

A normally open electric switch occupies a fixed position relative to motor M, which switch has a spring loaded member 42 projecting therefrom above second gear 34. Member 42 at all times tends to remain in a first position, when the member 42 moves upwardly to a second position by upward movement of second gear 34, the switch 40 assumes a closed position. Two insulated electrical conductors 44 are connected to motor M, with one of the conductors having the switch 40 connected in series therein. The conductors 44 extend through an opening 46 in the housing B to a source of electric power (not shown).

The inverted cup shaped head G has a top 48 secured to the lower end of driven shaft 36, and the top having a cylindrical sidewall extending downwardly therefrom. A centered tubular boss 52 extends downwardly from the top 48 within the cylindrical sidewall, which boss 52 has a closed upper end 52*a*.

A first compressed helical spring 54 encircles driven shaft 36 and bears against support plate 24 and top 46 to at all times tend to maintain head G in a first position.

A rod 56 is slidably mounted in boss 52, with the rod having an enlarged lower end 58 that may be pressure contacted by cap F. A second compressed helical spring encircles rod 56, with one end of the spring abutting against the lower end of boss 52, and the other end bearing against end 58. The second spring 60 at all times tends to maintain rod 56 in a first position. A set screw 62 extends through a tapped transverse bore 63 in boss 52. The inner end of screw 62 slidably engages a slot 64 in rod 56 to prevent the rod dropping out of boss 52. An opening 66 is formed in cylindrical sidewall 50 in alignment with screw 62. The opening 66 allows a suitable tool such as a screw driver (not shown) to be inserted therethrough to engage the set screw 62 to loosen or tighten the same.

A number of slotted cages H that are radially disposed and circumferentially spaced are secured to the interior surface of sidewall 50 by screws 68 as shown in FIG. 6. Each cage supports a transverse pin on which an elongate knife 72 is pivotally supported. Each knive 72 has a slightly convex inner cutting edge 72*a* that will indent into cap F when brought into pressure contact therewith. Each cage H and knife 72 has a third opening 74 operatively associated therewith as shown in FIG. 6 that at all times tends to maintain each knife in a first position. The lower edge of each knife 72 is slightly convex, and the inner portion of the lower edge contacting the cage H and acting as a stop to prevent the knife pivoting inwardly beyond the first position.

When a cap F is to be removed from a neck 10 of a bottle E, the neck is moved upwardly in the head G. The knives 72 pressure contact the cap F when in the first position. Continued upward movement of the neck 10 results in the knives pivoting to second positions, and the cap pressure contacting end 58 of rod 56. The rod 56 then moves upwardly towards a second position, and in so doing contacts closed end 52*a* to move driven shaft 36 and head G upwardly to second positions, with switch member 42 being moved to a second position due to upward movement of second gear 34. Motor M now drives head G to rotate together with the knives 72 to twist the cap F loose from neck 10. The bottle E is now moved downwardly relative to the head G, with spring 54 returning the head to the first position where it no longer rotates. Spring 60 now expands longitudinally and moves rod 56 from the second to the first position, and as a result the loosened cap moving downwardly relative to the knives 72. A spring 78 shown in FIG. 6 is secured to the interior surface of sidewall 50, with the spring having an inner end 78*a* that engages the cap F as the bottle E is moved downwardly relative to head G, and separates the loosened cap from the neck. The end 78*a* also serves to engage a paper label or covering (not shown) that may be secured to neck 10, and sever the label or covering therefrom.

The use and operation of the invention has been described previously in detail and need not be repeated.

What is claimed is:

1. A power driven device for twisting a crown cap loose from a circular head of a neck of a bottle on which said cap is crimped and then separating said cap from said head, said device including:

a. a rotational power generating assembly that includes support means, an electric motor mounted on said support means, a driven shaft; a bearing mounted on said support means that rotatably and slidably supports said driven shaft; a plurality of speed reducing gears rotatably supported from said support means and driven by said motor, with a first of said gears being elongate and rotating on an axis parallel to said shaft; electric circuit means for supplying electric power to said motor; and a normally open electric switch that forms a part of said electric circuit, said switch including a spring loaded member that when moved from a first position to a second position closes said electric circuit to energize said electric motor for the latter to drive said plurality of gears;

b. a second gear secured to said driven shaft that engages said first gear and may move longitudinally relative thereto, said second gear when said driven shaft moved longitudinally from a first to a second position causing said second gear to pressure contact said spring loaded member and move the same to said second position;

c. an inverted cup shaped head that includes a top and a cylindrical sidewall that extends outwardly therefrom, said top secured to an end of said driven shaft opposite from the end thereof that supports said second gear, said head including a tubular centered boss that extends outwardly from said top within said boss having a closed end adjacent said top, and said head having an open end through which said cap and neck may be moved towards said top;

d. first spring means that at all times tends to maintain said head in a first position in which said second gear and said switch actuating members are in said first positions;

e. a rod slidably mounted in said boss and extending outwardly therefrom;

f. second spring means that at all times tend to maintain said rod in a first position in which it is spaced from said closed end of said boss, but said rod capable of being moved to a second position to pressure contact said closed end to move said head in a direction to dispose said second gear and actuating member to said second positions; and g. cap engaging means that grip said cap when the latter is moved towards said top to a degree that it pressure contacts said rod to move said rod to said second position, with said head and cap engaging means being rotated to twist said cap from said head, and said rod as said bottle is thereafter moved away from said head moving from said second to said first position to force said cap that has been removed outwardly from said cap engaging means.

2. A device as defined in claim 1 which in addition includes:

h. means for separating said cap that has been loosened on said head from the latter as said cap and bottle are moved outwardly relative to said head, with said cap that has been separated dropping downwardly away from said head due to gravity.

3. A device as defined in claim 1 in which said engaging means include:

h. a plurality of circumferentially spaced slotted cages supported on the interior of said cylindrical wall;

i. a plurality of elongate knives pivotally supported in said cages;

j. third spring means that tend at all times to maintain said knives in first positions at which they will cut into said cap being moved upwardly in said head to grip said cap prior to said rod moving upwardly to contact said closed end, said third spring means allowing said knives to pivot to second positions after contacting said cap as said rod moves towards said closed end, with said third spring means returning said knives to said first position as said rod moves from said second to said first position.

4. A device as defined in claim 2 in which said means for separating said cap is a spring that extends outwardly from the interior surface of said cylindrical wall of said head.

5. A device as defined in claim 4 in which said spring has an outer cutting edge that bears against sheet material on the neck of said bottle and severs the same as said head rotates relative to said neck.

6. A device as defined in claim 1 which in addition includes:

g. a protective housing that defines a confined space in which said rotational power generating assembly, said second gear and cup shaped head are disposed, with access to the interior of said head being through an opening in said head.

7. A device as defined in claim 6 in which said bottle is a beer bottle and in addition includes:

h. means for supporting said housing from a portion of a bar at a convenient angle for beer bottles to be inserted in succession through said opening to have said caps removed therefrom.

* * * * *